United States Patent [19]

Strohband

[11] 4,256,027

[45] Mar. 17, 1981

[54] SPIRAL LABELLING

[75] Inventor: Rolf Strohband, Düsseldorf, Fed. Rep. of Germany

[73] Assignee: Guschky & Tönnesmann GmbH & Co. KG, Düsseldorf, Fed. Rep. of Germany

[21] Appl. No.: 911,972

[22] Filed: Jun. 2, 1978

[30] Foreign Application Priority Data

Jun. 3, 1977 [DE] Fed. Rep. of Germany ..... 2725116

[51] Int. Cl.[3] ..... B31C 3/00

[52] U.S. Cl. ..... 493/11; 493/287; 493/301

[58] Field of Search ..... 93/80, 43 R

[56] References Cited

U.S. PATENT DOCUMENTS

| | | | |
|---|---|---|---|
| 3,133,483 | 5/1964 | Glasby | 93/80 |
| 3,150,574 | 9/1964 | Glasby | 93/80 |
| 3,158,074 | 11/1964 | Brigham | 93/80 |
| 3,220,320 | 11/1965 | Brigham | 93/80 |
| 3,428,239 | 2/1969 | Wannamaker et al. | 229/5.6 |
| 3,942,418 | 3/1976 | Smith | 93/80 |

*Primary Examiner*—Robert D. Baldwin
*Attorney, Agent, or Firm*—Martin A. Farber

[57] ABSTRACT

A method and apparatus for the cutting of a helically wound tube made of strips of paper, cardboard or the like, into container cylinders having a labeling which is wound thereon by a wrapping belt, the drive speed of the cutting mechanism being compared with the feeding speed of the strip of labels, and a correction in the cutting being effected in the event of any difference. For the correction of the cut, the value resulting from the comparison of the drive speed of the cutting mechanism with the feeding speed of the strip of labels is used to control the speed of the wrapping belt.

15 Claims, 1 Drawing Figure

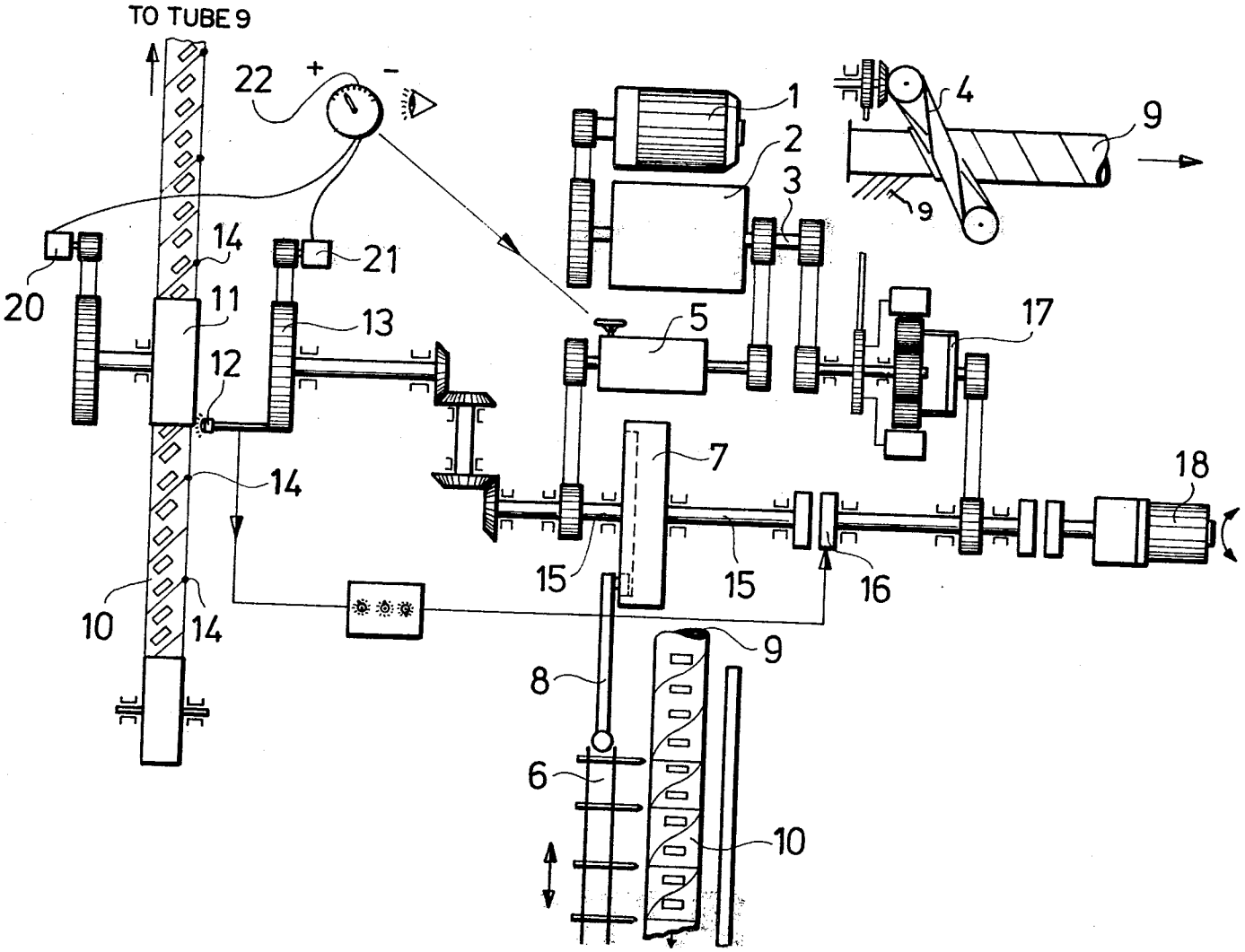
TO TUBE 9
1
2
3
4
5
6
7
8
9
10
11
12
13
14
15
16
17
18
20
21
22
+
-

SPIRAL LABELLING

This invention relates to a process and apparatus for the cutting of a helically wound tube formed of strips of paper, cardboard or the like into container cylinders having a labelling which is wound thereon by a wrapping belt, the drive speed of the cutting mechanism being compared with the speed of feed of the strip of labels and a correction in the cutting being effected in the event of any difference between them.

One such method of spiral labelling is already known. In it, the basic problem of controlling the cutting mechanism in such a manner that the spirally labeled cardboard tube is cut at precisely predetermined places is solved in the manner that the drive of the cutting mechanism is corrected by the value resulting from a comparison of the speed of drive of the cutting mechanism with the speed of delivery of the strip of labels. This method has the drawback that the correction of the cutting tool can be effected only with the use of expensive apparatus in the form of motors, clutches, and hydraulic, pneumatic and electronic adjusting devices. As a result, the correction device responds too slowly to unchecked changes in pitch or to variations in the thickness of the paper to avoid waste consisting of cut container cylinders.

The object of the present invention is to avoid these drawbacks and to provide a simple solution for the problem of cutting a helically wound tube of strips of paper, cardboard, or the like at precisely predetermined places. In particular, correction of the drive of the cutting mechanism is to be avoided.

This object is achieved, in accordance with the invention, in the manner that, for the correction of the cut, the value resulting from a comparison of the speed of drive of the cutting mechanism with the speed of delivery of the strip of labels is used to control the speed of the wrapping belt. In accordance with the invention therefore, the drive of the cutting mechanism is no longer corrected but, instead, the drive of the wrapping belt is controlled based on a difference in speed between two parameters of the system which are directly proportional to each other, in the manner that the belt is preferably imparted an additional rotating movement which allows the wrapping belt, and thereby the sleeve, to become slower, for which purpose the speed of the wrapping belt is at all times set a small percentage greater than the speed of the cutting mechanism. The reason for this is so that the speed of the wrapping belt need only be reduced in order to obtain a correction. In principle, however, an increase in the speed of the wrapping belt could also be used as correction in the carrying out of the method of the invention.

The comparison parameter may advantageously be determined by photoelectric scanning of control marks arranged at given distances apart on the labelling. The drive power for the correction of the speed of the wrapping belt is taken, in accordance with a preferred embodiment of the invention, from the drive of the cutting mechanism via an electromagnetic clutch which is controlled by the comparison parameter, and in particular by the photoelectric cell.

When carrying out the method of the invention, one determines, on basis of the speed comparison, whether the strip of labels is correctly positioned with respect to the adjustment of the cutting process which follows it in the course of the process or whether a correction must be effected. If a difference in the speed is noted, the speed of the wrapping belt, and thus the speed of the tube, are adjusted. The correction therefore takes place immediately when a deviation is noted, since only one coupling process need be brought about.

The apparatus for the carrying out of the spiral labelling process is characterized by a guide drum for the strip of labels, said drum being located as seen in the path of movement of said strip, in front of the tube; a continuously variably adjustable transmission for both the wrapping belt and the cutting mechanism, a photoelectric device arranged on the guide drum for scanning the control marks on the strip of labels, said scanning mechanism rotating with the speed of drive of the cutting mechanism; and an electromagnetic coupling arranged between the drive of the cutting mechanism and the drive of the wrapping belt and controlled by the photoelectric scanning device, said electromagnetic coupling introducing an additional rotary movement into the drive of the wrapping belt for the accelerating or decelerating of said belt. The guide drum preferably has a circumference which corresponds to one or one-half stroke of the cutting mechanism.

In order to facilitate the basic adjustment of the spiral labelling machine of the invention, it is advantageous to provide another gear motor which can be coupled to the drive of the wrapping belt. The basic adjustment can be carried out very rapidly and precisely, in particular if there is present an indication of the difference in value, if any, between the drive speed of the cutting mechanism and the speed of feed of the strip of labels, as well as a manual correction device on the drive of the differential gearing.

Further details, features, and advantages of the invention will be evident from the following description of the accompanying drawing, which diagrammatically shows a spiral labelling machine in accordance with the invention.

The device for the spiral labelling has a 7.5 KW electric motor 1 which has a differential transmission or gearing 2 which is continuously variable, so as to adjust the speed of the entire machine. To the output shaft 3 of the gearing 2 there is connected (and driven) on the one hand a wrapping belt 4 and on the other hand, via a continuously variable PIV-gearing 5, a cutting mechanism 6. The power transmission is effected here by means of a cam disk 7 and a connecting rod 8 which acts on the carriage (not shown) of the cutting mechanism 6.

The function of the wrapping device described is to wind, by means of the wrapping belt 4, strips of carton indicated by the four short inclined lines near the wrapping belt 4 in order to form a helically wound tube 9. Behind the tube 9 formed in this manner (as seen in the direction of motion), a label strip 10 is applied to the outside of the tube 9, as the label strip 10 itself is already schematically shown feeding toward the tube 9 at the left-hand side of the drawing for winding thereon. The label strip 10, upon application to the outside of the tube 9 via rotation of the tube 9, then represents the outermost layer of the tube 9 (note tube 9 with the labelling 10 thereon as schematically shown in the center bottom portion of the drawing adjacent the cutting mechanism 6), it having a given angle of inclination which corresponds to that of the carton strips which form the tube 9. On the outside of the tube 9 there is thus arranged a sequence of identical labels which, after the cutting by the cutting mechanism 6, form a plurality of individually labelled container cylinders.

The feeding of the label strip 10 to the tube 9 behind the wrapping belt 4 (as seen in the direction of motion) is effected via a guide drum 11 which has a circumference which corresponds to one or one-half a stroke of the knife carriage of the cutting mechanism 6. The label strip 10 is guided practically 360° around the guide drum 11.

Directly adjacent the guide drum 11, a photoelectric cell 12 is arranged on a ratchet wheel 13 which has approximately the same diameter as the guide drum 11, the photoelectric cell 12 being so arranged that the markings 14 present on the label strip 10 can be scanned. The ratchet wheel 13 is driven together with the drive shaft 15 of the cam disk 7 of the cutting mechanism 6 and rotates with the speed of the cam, which speed corresponds to that of the knife carriage.

The shaft 15 continues also on the other side of the cam 7. Via an electromagnetic clutch 16, the drive of the cutting mechanism is connected with the drive of the wrapping belt 4, into the differential gearing 17 of which an additional movement can be imparted when the electromagnetic clutch 16 is engaged.

As shown to the far right in the drawing, there is also connected to the differential gearing 17 a gear motor 18 which rotates clockwise or counterclockwise and with which motor one can engage into the differential upon readjustment of the machine. This engagement is effected by the depressing of a button and assists in bringing the printing of the labelled tube 9 into agreement with the knife set of the cutting mechanism 6. The automatic synchronization correction with the photoelectric cell might possibly take too long upon a readjustment of the machine, since, upon starting, the cutting mechanism 6 might be in advance of the tube 9 which would result in numerous defectively cut container cylinders. In accordance with the preferred embodiment of the labelling machine which has been shown in the drawing, the drive of the wrapping belt 4 can only be slowed down, since upon the spiral labelling one proceeds, by adjustment of the PIV-gearing 5, in such a manner that the speed of the belt is always a small percentage greater than the speed of the cutting mechanism.

Another possibility has not been shown in the drawing, namely the use of two photoelectric cells in order to be able to detect and correct any shifting of the tube 9 in either direction (faster or slower). With such a device the advantage would be obtained that the lead or lag of the wrapping belt 4 can be kept very small.

Finally, the labelling machine shown in the drawing has an rpm indicator 20 for the speed of rotation of the guide drum 11 and an rpm indicator 21 for the speed of rotation of the ratchet wheel 13, and thus of the cam disk 7, the difference between them being indicated by an instrument 22 for optical verification whereby one can act manually on the PIV gearing 5 in order to change the speed of the cutting mechanism, as has been shown schematically in the drawing. The PIV gearing 5 serves fundamentally to adapt the speed of the cutting mechanism to the speed of the wrapping belt, which changes for different diameters and pitches. The PIV gearing 5 is therefore frequently adjusted by hand, and this adjustment of synchronism is facilitated in the manner that the indicating instrument 22 indicates the difference between the cutting-mechanism speed and the tube speed or respectively the guide-drum speed.

As already mentioned, upon the spiral labelling the adjustment is effected on the PIV gearing 5 in such a manner that the speed of the belt and thus the speed of the tube are always a small percentage greater than the speed of the cutting mechanism. In this way it is possible, when synchronism (correction) has been obtained that the belt speed need then only be reduced. This correction is effected automatically:

The label strip 10 passes over the guide drum 11 alongside of which the photoelectric cell 12 rotates with the speed of the cutting-mechanism cam 7. In this connection, the photoelectric cell senses the markings 14 arranged on the label strip 10 a distance apart equal to the length of a can. If the photoelectric cell does not rotate with the same speed as the marking 14 on the label strip 10, it then imparts a pulse, via an amplifier, to the electromagnetic clutch 16, which connects the differential gearing 17 to the shaft 15 and introduces an additional rotary movement into the differential gearing 17. In this way the speed of the wrapping belt 4 is decreased.

For correction, the photoelectric cell has available to it the entire path of the label strip 10 over the guide drum 11. The correction is therefore effected correctly, immediately upon the occurrence of a deviation, so that the cutting mechanism 6 always cuts the tube 9 at the precisely predetermined places.

I claim:

1. A method for the cutting of a helically wound tube made of strips of paper, cardboard or the like with a cutting mechanism, into container cylinders having a labelling constituting a strip of labels wound thereon by a wrapping belt, comprising the steps of winding strips of material by means of a wrapping belt to form a progressing helically wound tube, feeding a strip of labels to the tube and helically winding the strip onto said tube, driving the cutting mechanism along a path parallel to the tube, cutting the tube with the labelling thereon, measuring the drive speed of the cutting mechanism and the feeding speed of the strip of labels, comparing the drive speed of the cutting mechanism with the feeding speed of the strip of labels and providing a comparison value resulting therefrom, controlling the speed of the wrapping belt by the value resulting from the step of comparing the drive speed of the cutting mechanism with the feeding speed of the strip of labels for correcting the cutting in the event of any difference between the drive speed and the feeding speed.

2. The method according to claim 1, further comprising the step of setting the speed of the wrapping belt a small percentage greater than that of the cutting mechanism in a basic adjustment.

3. The method according to claim 1, further comprising the step of determining the comparison value by photoelectrically scanning of control marks arranged at predetermined distances apart from one another on the strip of labels.

4. The method according to claim 1, further comprising the step of taking the drive power for correction of the speed of the wrapping belt from the drive of the cutting mechanism via an electromagnetic clutch, controlling the electromagnetic clutch by the comparison value.

5. The method according to claim 4, further comprising the step of determining the comparison value by operatively photoelectrically scanning the strip of labels.

6. The method as set forth in claim 1, wherein the cutting mechanism includes a knife carriage moveable back and forth parallel to the tube and wherein the step of comparing is performed by comparing the advance speed of the knife carriage parallel to the tube with the unrolling speed of the strip of labels before winding the latter on the tube behind the winding belt.

7. An apparatus for cutting of a helically wound tube made of strips of material such as paper, cardboard or the like into container cylinders having a labelling constituting a strip of labels wound thereon by means of a wrapping belt, the apparatus comprising a wrapping belt means for winding the strips of material to form a progressing helically wound tube and for operatively indirectly winding a labelling comprising a strip of labels on the helically wound tube, guide drum means for cooperating with the strip of labels, said guide drum means being located in a path of movement of the strip of labels winding onto the tube in front of the tube, cutting means for cutting said tube with said labels thereon, drive means for driving said cutting means along a path parallel to the tube and drive means for driving said wrapping belt means, respectively, a continuously variably adjustable transmission means operatively connected to said drive means, respectively, for both said wrapping belt means and said cutting means, photoelectric scanning means for detecting control marks on the strip of labels and being arranged adjacent said guide drum means, said scanning means rotating with the drive speed of the cutting means, electromagnetic coupling means being selectively operatively connected between said drive means for said cutting means and said drive means for said wrapping belt means, said coupling means being controlled by said photoelectric scanning means, said electromagnetic coupling means including means for introducing an additional rotary movement into said drive means for said wrapping belt means when said scanning means does not rotate with the same speed as the marks on the strip of labels on the guide drum means.

8. The apparatus according to claim 7, further comprising a differential transmission operatively connected to said coupling means and said drive means of said wrapping belt means.

9. The apparatus according to claim 7, wherein said guide drum means has a circumference corresponding to one stroke of said cutting means.

10. The apparatus according to claim 7, wherein said guide drum means has a circumference corresponding to one half a stroke of said cutting means.

11. The apparatus according to claim 7, further comprising another drive means constituting a gear motor is selectively coupleable to said drive means of said wrapping belt means.

12. The apparatus according to claim 7, further comprising indicator means for indicating a difference in value between the drive speed of said cutting means and the feeding speed of the strip of labels, and a manual correction means for correcting the cutting operatively connected between said drive means for said cutting means and said continuously variably adjustable said transmission means, the latter constituting a differential transmission.

13. The apparatus according to claim 12, wherein said manual correction means is a PIV-transmission.

14. The apparatus as set forth in claim 7, wherein said drive means for driving said cutting means along a path parallel to the tube includes a knife carriage mounted for movement back and forth parallel to the tube, said scanning means is adapted for rotating with the advance speed of the knife carriage parallel to the tube, said advance speed constituting the drive speed of the cutting means, said guide drum means is adapted for feeding the strip of labels to the tube behind the winding belt.

15. The apparatus as set forth in claim 14, wherein said drive means for driving said cutting means includes a rotatably mounted cam disk operatively driveably connected to said knife carriage, said scanning means being rotatably connected with, and for rotating with the speed of and measuring the rotational speed of, said cam disk.

* * * * *